United States Patent [19]

Corsmeier, Jr.

[11] Patent Number: 4,485,927

[45] Date of Patent: Dec. 4, 1984

[54] FLATWARE SORTER

[76] Inventor: Joseph W. Corsmeier, Jr., 806 Canyon Rd., Redwood City, Calif. 94062

[21] Appl. No.: 336,875

[22] Filed: Jan. 4, 1982

[51] Int. Cl.[3] ..... B07C 5/06

[52] U.S. Cl. ..... 209/621; 209/666; 209/926

[58] Field of Search ..... 209/606, 621, 656, 658, 209/659, 660, 666, 707, 926

[56] References Cited

U.S. PATENT DOCUMENTS 3,394,804 7/1968 Reichel ..... 209/926 X 3,900,107 8/1975 Hoppmann ..... 209/707 X

*Primary Examiner*—Robert B. Reeves

*Assistant Examiner*—Edward M. Wacyra

[57] ABSTRACT

The invention is a motor driven device designed for the purpose of separating and sorting flatware, fed to the unit in random fashion. A hopper receives the pieces, and the speed of a concaved separating disc is employed to separate the flatware and move it handle first between the sorting disc and guides. The pieces are measured by the relation of the guides to the circumference of the disc and dropped into individual collection boxes. A threaded stud may be employed for the adjustment of the machine to a variety of patterns of flatware.

6 Claims, 6 Drawing Figures

FLATWARE SORTER

BACKGROUND OF THE INVENTION

Flatware sorters manufactured in the past, have been larger machines, not easily adaptable to existing scullery arrangements without some rearrangement or preplanning of scullery areas. The portability and size of this device, with it's approximate size of thirty inches square, makes it easily adaptable to most kitchens and ware washing rooms.

The idea of sorting flatware by means of vibration, causes a noise factor not present in this machine. This machine is constructed of heavy, high impact plastic, thus eliminating the noise factor which is present in metal to metal contact. It is a well known fact that many institutions serving large quantities of food, sort their flatware by hand. The cost of manpower for the manual sorting of flatware has caused many food service operations to revert to the use of plastics. While the purchase of plastics is perhaps less expensive than the alternative of manual sorting, it is nevertheless an ongoing expense that could be eliminated by the use of this machine. Further, plastic is a petroleum product, and limited use of petroleum products should be a benefit to the national economy.

This machine allows for a more sanitary operation by eliminating the unnecessary handling of the utensils between their washing and reutilization.

The machine measures each piece three ways, by the depth, width and utility end and the length of the handle, to allow for a high degree of accuracy.

The sorting and handle guides can be adjusted by the threaded stud, to permit simultaneous sorting of multiple patterns. The machine is also able to sort the pieces as quickly as they are fed making it unnecessary to regulate the number of utensils fed at one time.

The simple design of this machine, consisting of only two moving parts, means that it can be produced and marketed at a competitive price.

The simplicity also allows for low maintenance.

SUMMARY OF THE INVENTION

The flatware sorter comprises a funnel shaped hopper with a concave separating disc inside, a sorting disc below the hopper on a center shaft, and guides attached to the hopper, all powered by a motor.

One objective of this invention is to provide for a sanitary means of sorting flatware, accomplished by less handling. Another objective of this invention is to provide a quiet machine, accomplished by its construction of plastic. Another objective of this invention is a means of sorting flatware with a high degree of accuracy, accomplished by the measuring of the pieces three ways as described in the background.

Another objective of this invention is to allow the user the freedom of a variety of patterns, made possible by the use of the threaded stud to adjust the handle and sorting guides.

Another objective of this invention is to provide a machine that will not "jam", or make it necessary to regulate the flow of flatware. This is accomplished by the use of centrifugal force.

The final objective of this machine is to give to the food service industry, a machine that will fit into most kitchens without the need for major renovation. This is accomplished by it's size and portability.

Figure 1:
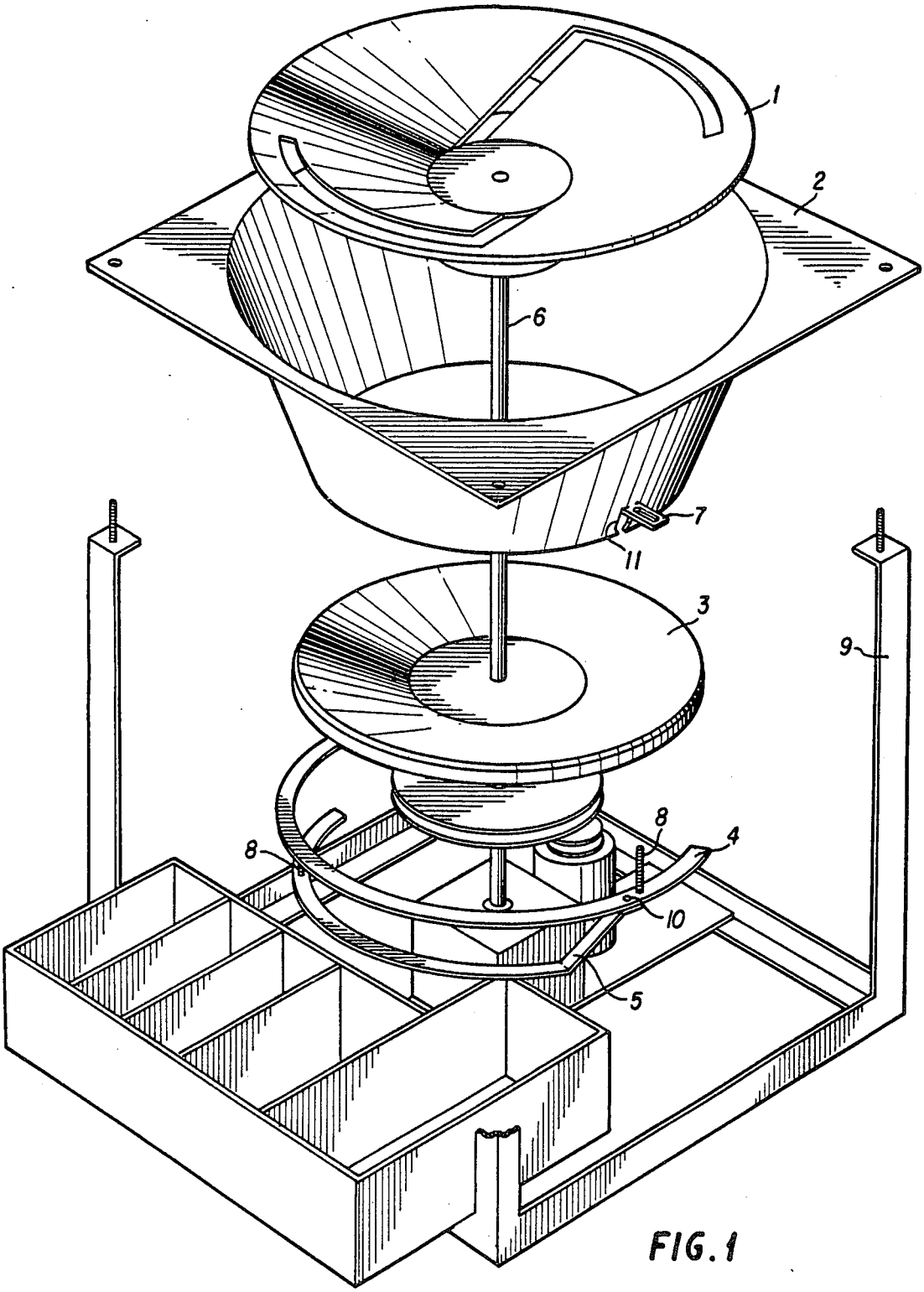
FIG. 1 is an assembly drawing of a flatware sorter.

Each of these drawings comprises a portion of FIG. 1.

DESCRIPTION OF THE PREFERRED EMBODIMENT

For the purpose of promoting an understanding of the invention, references will now be made to the embodiment illustrated in the drawings.

The depicted apparatus (FIG. 1) includes a funnel shaped hopper (FIG. 1#2) mounted on a frame of conventional square design. This frame is shown in FIG. 1.

A concaved separating disc (FIG. 1#1), slotted near the perimeter on opposite sides of the center, is located inside the hopper.

Figure 3:
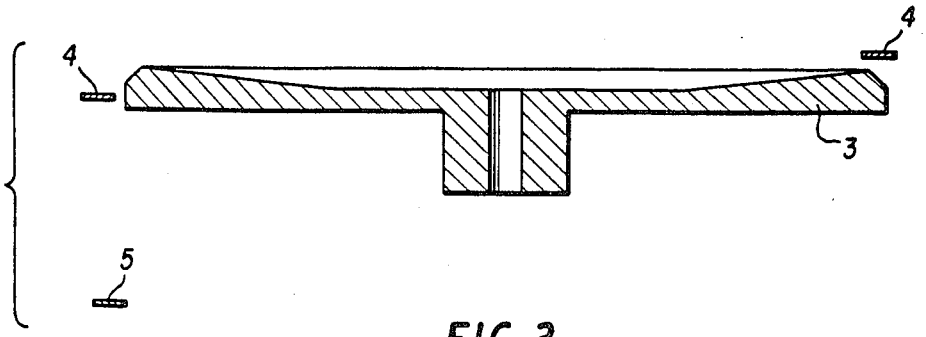
FIG. 3 is a section view of FIG. 2.
Figure 4:
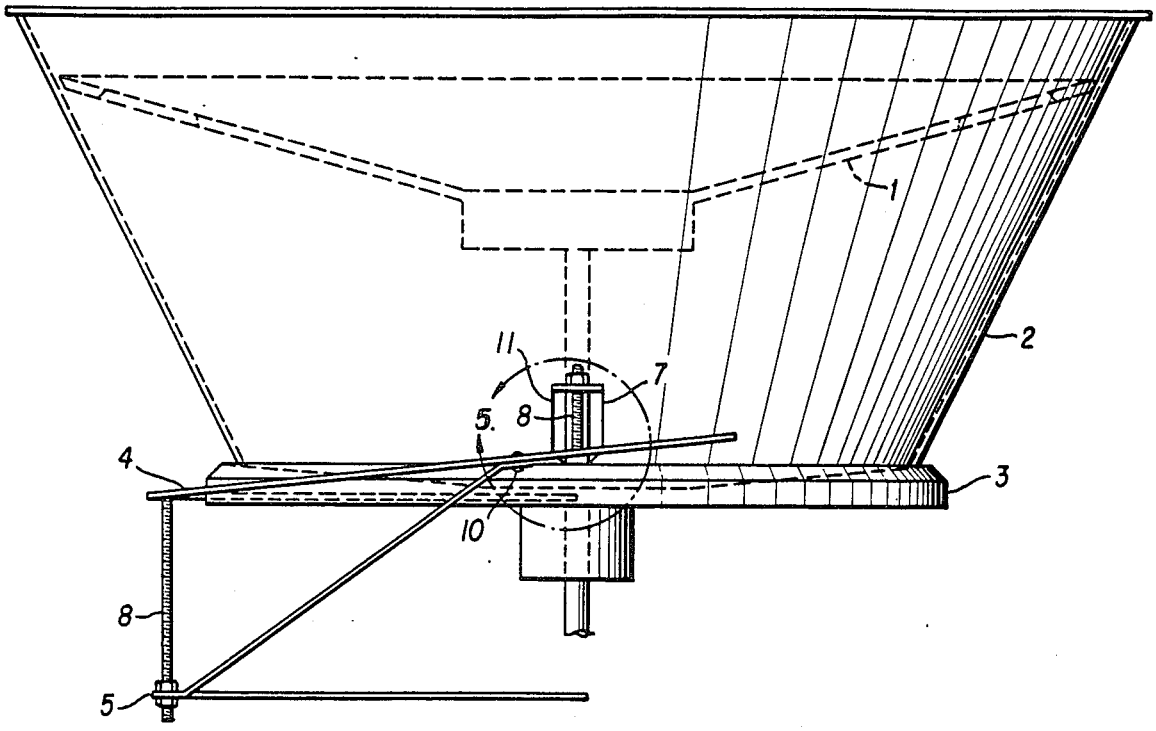
FIG. 4 is a right side view showing the hopper, separating disc, sorting disc, handle and sorting guides.
Figure 5:
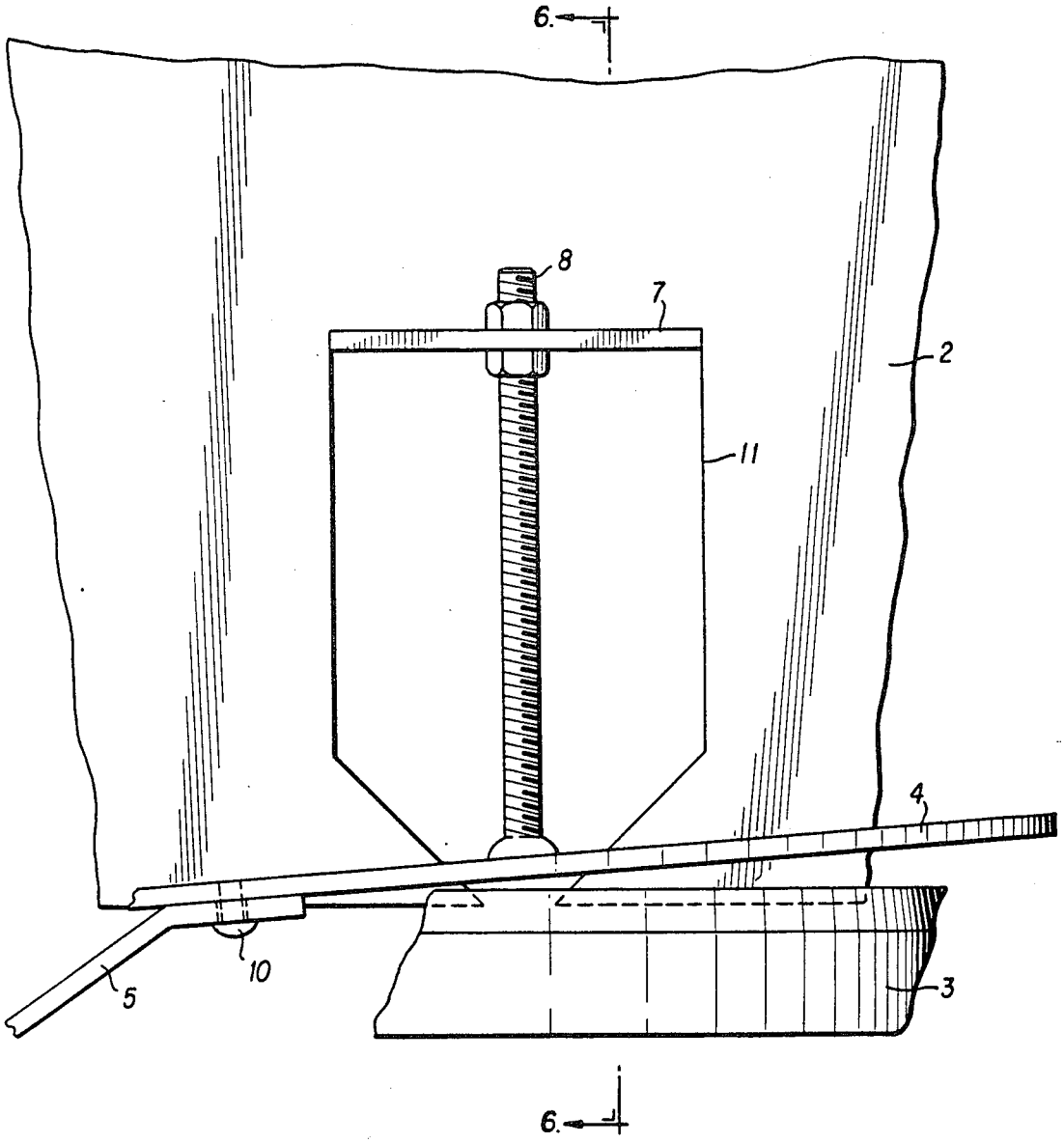
FIG. 5 is a right side view of the discharge slot in the bowl of the hopper and the disc, guides and the threaded stud and its slotted mount.
Figure 6:
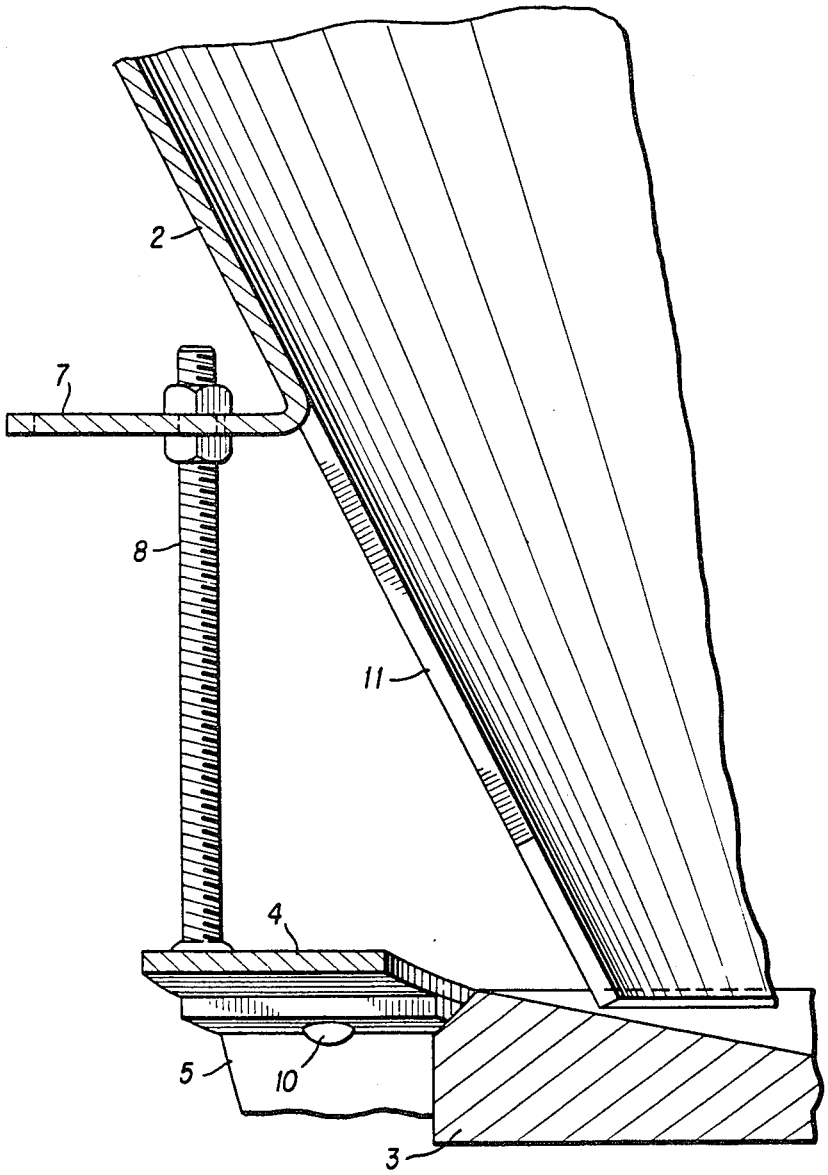
FIG. 6 is a view from the right back corner showing the hopper, disc and guides.

A sorting disc (FIGS. 1 and 3#3) with a concave shaped surface, angled 45 degrees vertically downward and radially outward at the top edge of the circumference and angled toward the center of the disc at approximately 5 degrees, is located just below the hopper and connected by a center shaft (FIG. 1#6) to the separating disc (FIG. 1#1).

A sorting guide (FIGS. 1–5#4) is attached to the frame and the hopper on a slotted mount (#7 FIGS. 1, 3, 4, 5) above the discharge slot (#11 FIGS. 1, 3, 4, 5) in the hopper (FIG. 3#7) and is adjustable by a threaded stud (FIGS. 1, 3, 4, 5,#8).

Figure 2:
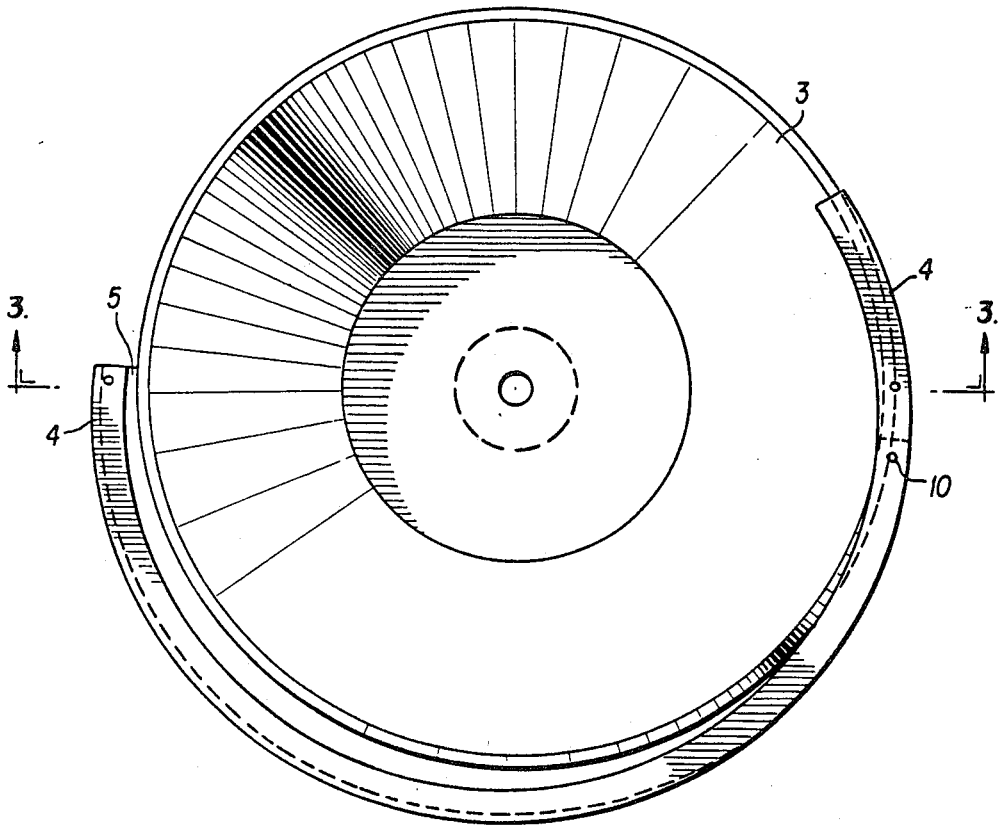
FIG. 2 is a top view of the sorting disc and sorting and handle guides.

Both the sorting guide and the handle guide are semi circular tracks of the same radius as depicted in FIG. 2#4 and 5.

The handle guide (5 FIGS. 1, 2, 3, 4, 5) angles down off of the sorting guide to the left side of the discharge slot (FIGS. 1, 3, 4#5) and the distance between these guides is adjustable by the threaded stud (FIGS. 1, 3, 4, 5#8).

Refering to FIG. 1, the flatware is loaded in the top of the hopper (2). When the center shaft is rotated in a clockwise direction, the flatware is separated and spread out above the separating disc (1) and is released through the slots in the disc (1) in an evenly controlled manner, and thus onto the sorting disc (3).

The flatware then slides out of the gap between the hopper (2) and the sorting disc (3) handle first. The handles are caught on the bottom edge of the sorting guide (4) and are moved out through the discharge slot (11).

The utility end of the flatware is then caught between the disc (3) and the sorting guide (4).

At this point, the knives, due to their shape and weight, drop into their receptacle (shown in FIG. 1, but not numbered). The other pieces move around the guide (4 and 5) using the circumference of the disc (3) and are held in their position by the sorting guide (4) and the handle guide (5).

The sorting guide is adjusted by the threaded stud (8) so that the distance between the guide (4) and the disc (3) becomes greater as the pieces move along it (guide 4).

The handle guide (5) is set on the same radius as the sorting disc (3) creating pressure on the utility end between the sorting disc and sorting guide. The flatware is measured by the depth and width of the utility end, by the perimeter of the disc and by the relation of the sorting guide (4) and the length of the handle and by the distance between the sorting guide and handle guide.

That which is claimed is:

1. An apparatus for separating flatware comprising:

(a) a frame structure (b) a funnel shaped hopper mounted on said frame structure for receiving flatware in random mix fashion;

(c) a separating means, within said hopper, for presenting individual pieces of said flatware to a discharge opening in said hopper;

(d) a disc positioned beneath said hopper;

(e) means for rotating said disc;

(f) a plurality of receptacles receiving specific pieces of said flatware; and (g) semi-circular guide means adjustably secured to said hopper to define a gauging passage between said hopper and said rotating disc whereby said individual pieces of said flatware are circumferentially moved from said discharge opening by the cooperation of said rotating disc and said semi-circular guide means to said receptacle for said specific piece of said flatware.

2. An apparatus according to claim 1 wherein said separating means comprises a rotating concave separating disc.

3. An apparatus according to claim 1 wherein said semi-circular guide means are adjustably secured by threaded studs.

4. An apparatus according to claim 3 wherein said semi-circular guide means are positioned above said rotating disc at said discharge opening and increasingly spaced from the perimeter of said rotating disc in the direction of rotation.

5. An apparatus according to claim 1 wherein said semi-circular guide means are positioned above said rotating disc at said discharge opening and increasingly spaced from the perimeter of said rotating disc in the direction of rotation.

6. An apparatus according to claim 1 wherein said rotating disc is concave shaped.

* * * * *